US008967507B2

(12) United States Patent
Pusheck et al.

(10) Patent No.: US 8,967,507 B2
(45) Date of Patent: Mar. 3, 2015

(54) MOVEABLE SHAFT ASSEMBLY

(75) Inventors: Bernard Pusheck, Cudahy, WI (US); Russell Cascio, Brown Deer, WI (US); Justin Zunker, Port Washington, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 521 days.

(21) Appl. No.: 13/307,072

(22) Filed: Nov. 30, 2011

(65) Prior Publication Data

US 2012/0132739 A1 May 31, 2012

Related U.S. Application Data

(60) Provisional application No. 61/458,709, filed on Nov. 30, 2010.

(51) Int. Cl.
*B02C 4/32* (2006.01)
*B02C 4/08* (2006.01)
*B02C 4/42* (2006.01)

(52) U.S. Cl.
CPC ... *B02C 4/08* (2013.01); *B02C 4/32* (2013.01); *B02C 4/42* (2013.01)
USPC ..... 241/32; 241/231; 241/236; 241/285.2

(58) Field of Classification Search
USPC ..... 241/32, 235, 236, 231, 234, 285.2
See application file for complete search history.

(56) References Cited

U.S. PATENT DOCUMENTS

| | | | | |
|---|---|---|---|---|
| 4,339,083 | A | 7/1982 | Linzberger et al. | |
| 4,763,845 | A | 8/1988 | Guggenheimer et al. | |
| 5,372,315 | A | 12/1994 | Kranz et al. | |
| 5,441,206 | A | 8/1995 | Schade et al. | |
| 5,522,557 | A | 6/1996 | Tiggesbaumker et al. | |
| 5,813,617 | A | 9/1998 | Thoma | |
| 6,836,089 | B2 * | 12/2004 | Siebert | 318/434 |

(Continued)

FOREIGN PATENT DOCUMENTS

| | | |
|---|---|---|
| CN | 86104686 | 1/1988 |
| CN | 2675254 | 2/2005 |
| CN | 201040252 | 3/2008 |

(Continued)

OTHER PUBLICATIONS

Patent Examination Report No. 1 from Intellectual Property Office of Australia for Application No. 2011253613 dated Feb. 11, 2014 (5 pages).

(Continued)

*Primary Examiner* — Mark Rosenbaum

(74) *Attorney, Agent, or Firm* — Michael Best & Friedrich LLP

(57) ABSTRACT

A moveable shaft assembly including a frame, a first shaft, and a first drive assembly. The frame includes a first support wall and a second support wall opposite the first support wall. The first shaft includes a drive end and a support end and defining a first axis therebetween. The first shaft extends between the first support wall and the second support wall. The first drive assembly rotates the first shaft about the first axis, and the first drive assembly is coupled to the drive end of the first shaft. The first shaft and first drive assembly are moveable relative to the frame in response to a reaction force acting on the first shaft in a direction oblique or transverse to the first axis.

22 Claims, 6 Drawing Sheets

(56) References Cited

U.S. PATENT DOCUMENTS

| | | | |
|---|---|---|---|
| 8,020,800 | B2 | 9/2011 | Potts |
| 2003/0102827 | A1 | 6/2003 | Siebert |

FOREIGN PATENT DOCUMENTS

| | | |
|---|---|---|
| CN | 101489682 | 7/2009 |
| CN | 101559392 | 10/2009 |
| CN | 101722079 | 6/2010 |
| GB | 190912087 | 5/1910 |
| GB | 498224 | 1/1939 |
| GB | 1192354 | 5/1970 |
| WO | 99/54049 | 10/1999 |
| WO | 2004/018106 | 3/2004 |

OTHER PUBLICATIONS

Notification of First Office Action from the State Intellectual Property Office Of The People's Republic of China for Application No. 201110459584.5 dated Oct. 21, 2014 (39 pages).

* cited by examiner

MOVEABLE SHAFT ASSEMBLY

BACKGROUND

The present invention relates to the field of mining machines, and particularly to a roll sizer for breaking apart and crushing mined material.

Conventional mining roll sizers include a pair of parallel counter-rotating roll assemblies positioned within a crushing chamber. The shafts include a series of picks arranged along the surface. As the roll assemblies rotate, the picks engage material that is fed into the crushing chamber, breaking the material apart until it is small enough to pass around the rolls. During normal operation, it is possible for the chamber to receive a tramp material, which is a very hard, dense material. The picks are unable to break apart the tramp material and pass it through the crushing chamber, causing the rolls to bind and one or more picks to break. This requires the roll sizer to be shut down so that the tramp can be removed and any necessary repairs be made to the roll assemblies.

SUMMARY

In one embodiment, the invention provides a moveable shaft assembly includes a frame, a first shaft, and a first drive assembly. The frame includes a first support wall and a second support wall opposite the first support wall. The first shaft includes a drive end and a support end and defines a first axis therebetween. The first shaft extends between the first support wall and the second support wall. The first drive assembly rotates the first shaft about the first axis, and the first drive assembly is coupled to the drive end of the first shaft. The first shaft and first drive assembly are moveable relative to the frame in response to a reaction force acting on the first shaft in a direction oblique or transverse to the first axis.

In another embodiment, the invention provides a roll sizer for a mining crusher, the roll sizer including a frame, a first mobile shaft support, a second mobile shaft support, a first shaft, and at least one actuator. The frame includes a first support wall and a second support wall. The first support wall includes a first shaft track, and the second support wall includes a second shaft track parallel to the first shaft track. The first mobile shaft support moveably engages the first shaft track. The second mobile shaft support moveably engages the second shaft track. The first shaft includes a drive end and a support end and defines a first axis therebetween. The drive end is coupled to a first gear drive for rotating the first shaft about the first axis. The first shaft extends from the first support wall to the second support wall, and is rotatably supported by the first mobile shaft support and the second mobile shaft support. The at least one actuator applies a force to move the first and second mobile shaft supports along the first and second shaft support tracks, respectively. The first drive assembly moves in a direction parallel to the mobile shaft supports while coupled to the first shaft.

In yet another embodiment, the invention provides a method for adjusting a shaft spacing in a roll sizer. The method includes: providing a first shaft defining a first axis and a second shaft defining a second axis parallel to the first axis, the first shaft being rotatable about the first axis; providing a drive assembly coupled to the first shaft for rotating the first shaft; sensing the forces acting on the first shaft; and operating an actuator to provide a force to move the first shaft from a position that is a first distance from the second shaft to a position that is a second distance from the second shaft, the second distance being greater than the first distance, wherein the drive assembly moves with the first shaft.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Although the invention is described below as it relates to a roll sizer, it is important to note that the invention is also applicable to conveyors having a moveable shaft or other devices having a drive shaft that is moveable in response to a force.

Figure 1:
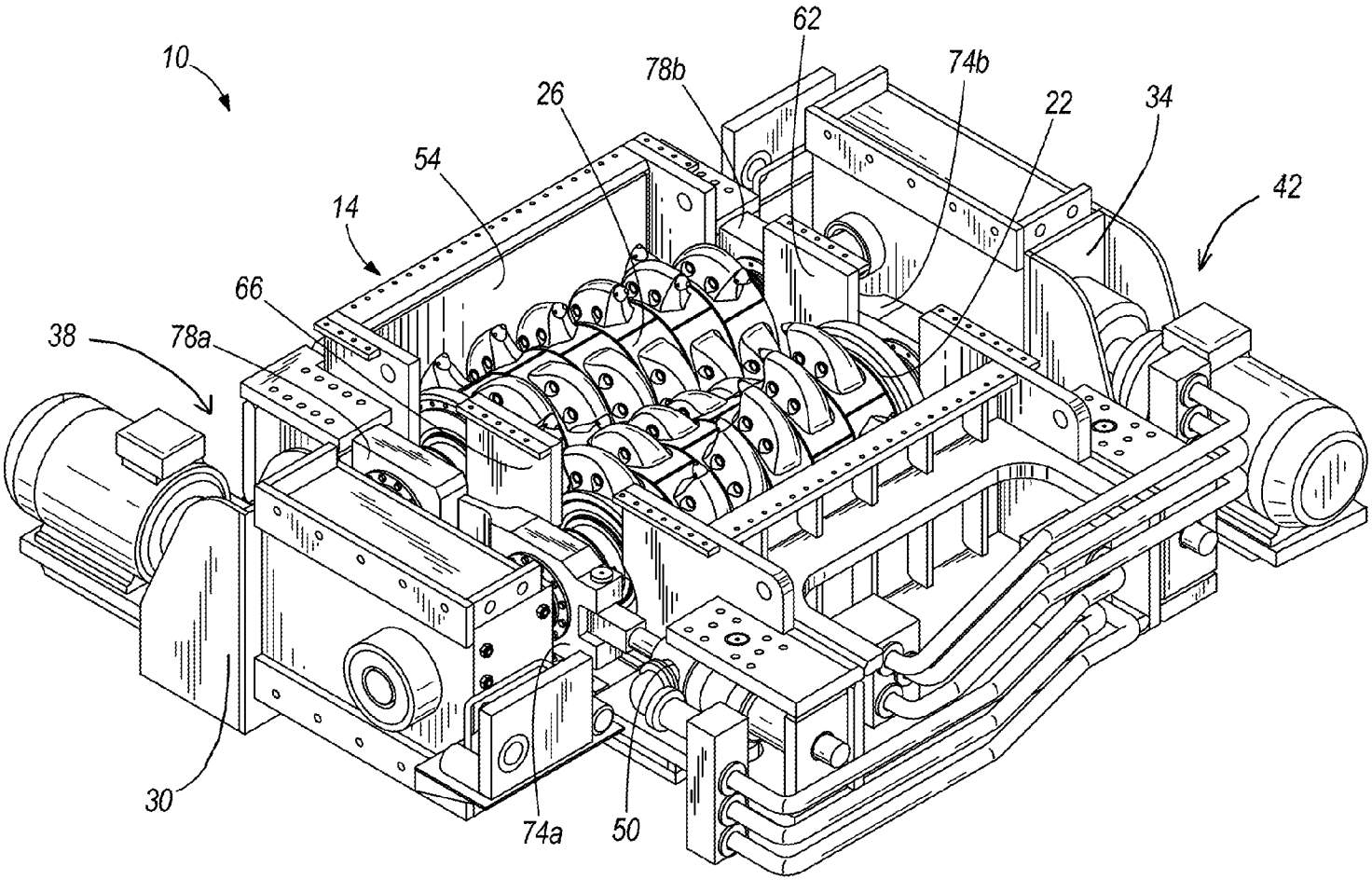
FIG. 1 is a perspective view of the roll sizer according to one embodiment of the invention.

FIG. 1 illustrates a mining roll sizer 10. The roll sizer 10 includes a frame 14, a first roll assembly 22, a second roll assembly 26, a first carriage 30, a second carriage 34, a first drive assembly 38 supported by the first carriage 30, a second drive assembly 42 supported in the second carriage 34, and an actuator 50. The frame 14 defines an interior chamber 54. In one embodiment the interior chamber 54 has a rectangular shape. The frame 14 includes a first support wall 62, a second support wall 66 mounted opposite the first support wall 62, a pair of mobile shaft supports 74*a*, 74*b* for rotatably supporting the first roll assembly 22, a pair of stationary shaft supports 78*a*, 78*b* for rotatably supporting the second roll assembly 26, and a torque arm 80 (FIG. 5). The first support wall 62 and the second support wall 66 each include an elongated slot 82 (FIG. 4) extending through each respective support wall 62 and 66. The first support wall 62 and the second support wall 66 each include a track 86 (FIG. 4) positioned adjacent the slot 82. Each of the mobile shaft supports 74*a*, 74*b* moveably engages one of the tracks 86. In the illustrated embodiment, the mobile shaft supports 74*a*, 74*b* slidably engage the tracks 86. In other embodiments, the mobile shaft supports 74*a*, 74*b* may move in another manner, such as rolling with respect to the tracks 86. The torque arm 80 is discussed in further detail below.

Figure 2:
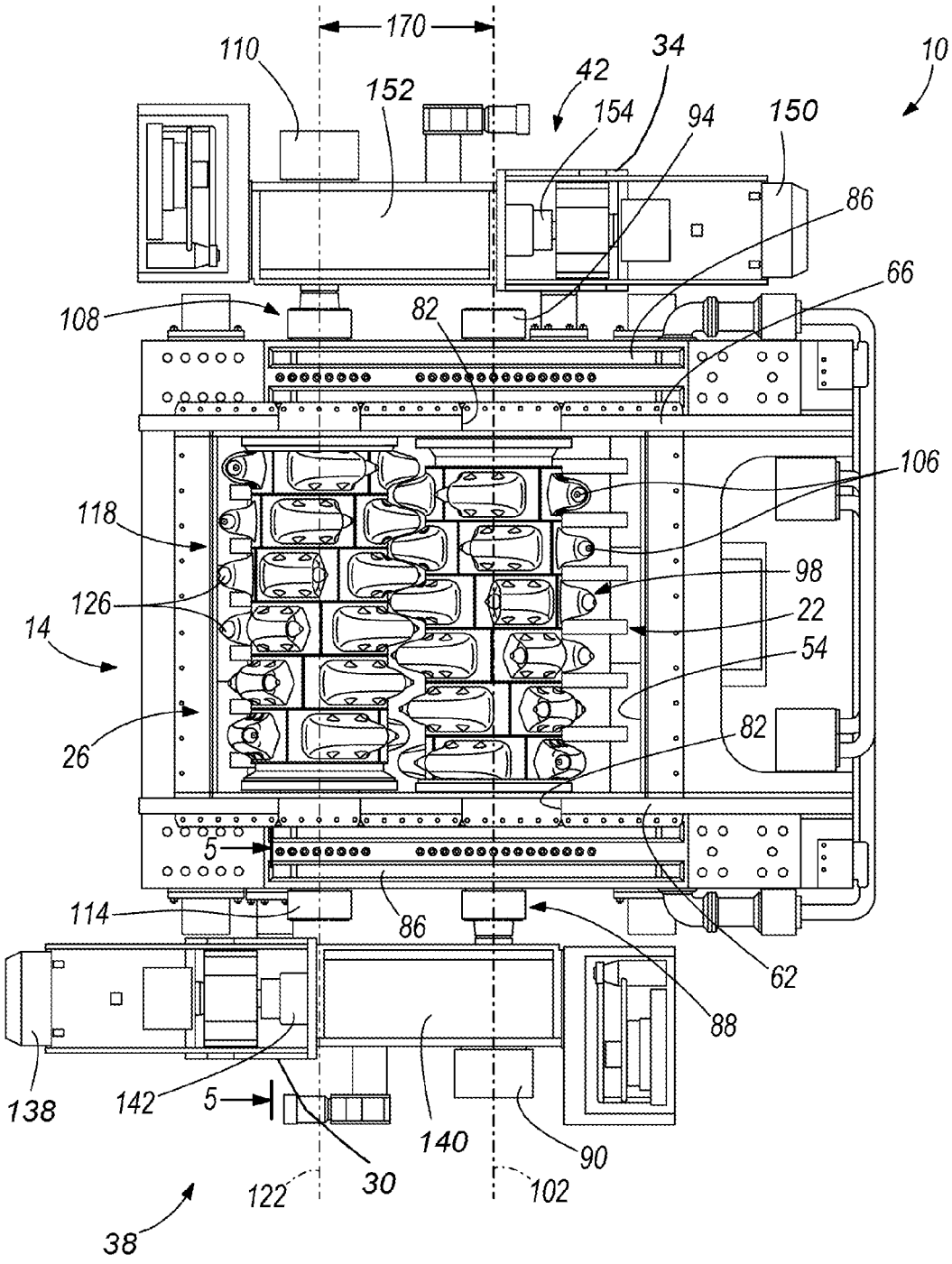
FIG. 2 is a top view of the roll sizer of FIG. 1 wherein a first roll assembly is positioned proximate a second roll assembly.
Figure 3:
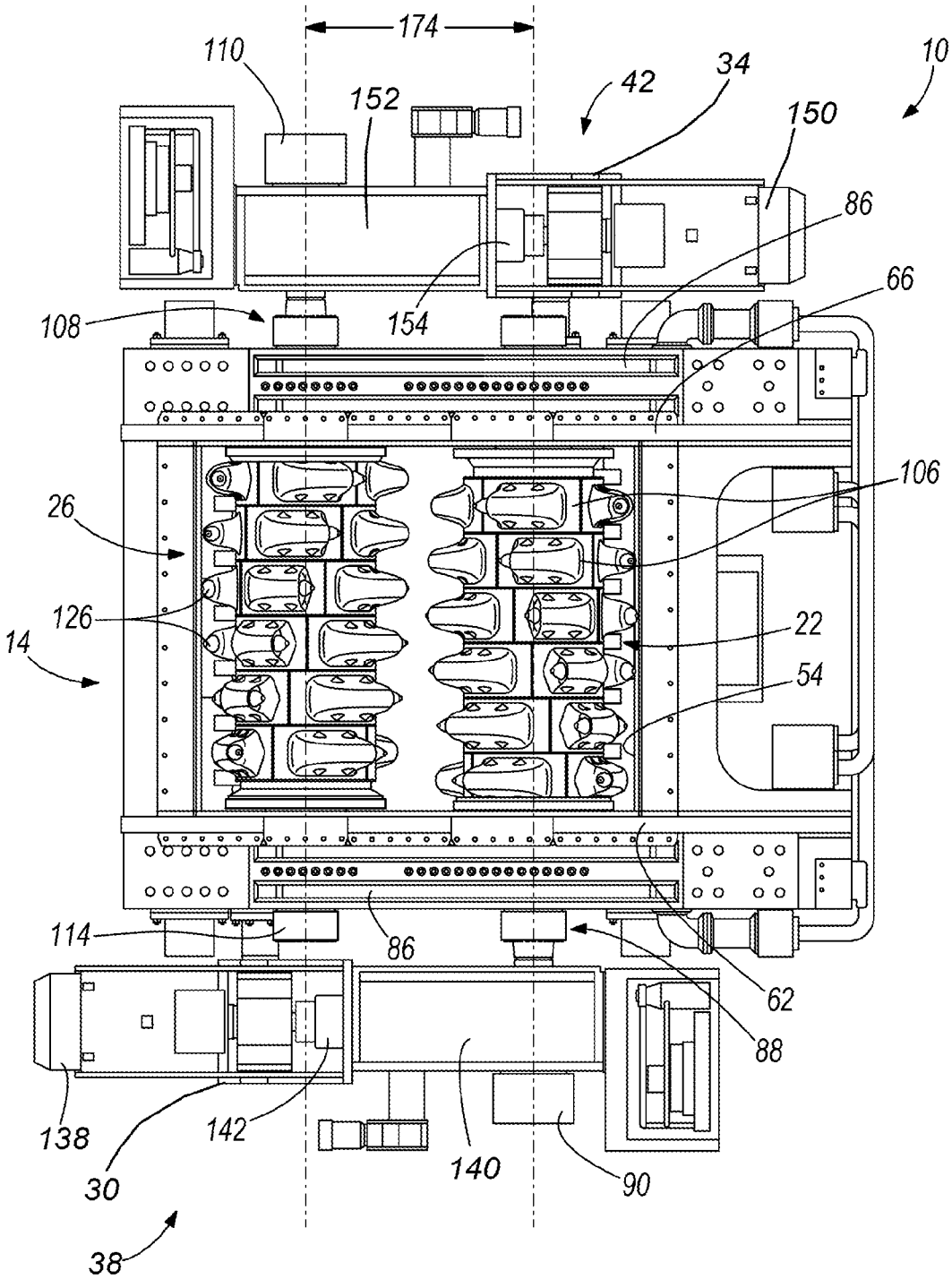
FIG. 3 is a top view of the roll sizer of FIG. 1 wherein the first roll assembly is positioned away from the second roll assembly.

As shown in FIGS. 2 and 3, the first roll assembly 22 is positioned substantially within the interior chamber 54 and includes a first shaft 88 having a drive end 90 and a support end 94 opposite the drive end 90. The first roll assembly 22 also includes a crushing portion 98 coupled to the first shaft 88. The first shaft 88 defines a first axis 102 between the drive end 90 and the support end 94. The drive end 90 extends through the slot 82 in the first support wall 62 and is coupled to the first drive assembly 38 for rotating the first roll assembly 22. The drive end 90 is rotatably supported by a first mobile shaft support 74*a*. The support end 94 extends through the slot 82 of the second support wall 66 and is rotatably supported by a second mobile shaft support 74*b*. In one embodiment, the mobile shaft supports 74*a*, 74*b* include a tapered roller bearing for rotatably supporting the first shaft 88. In other embodiments, another type of bearing may be used. The crushing portion 98 is located within the interior chamber 54 and includes multiple picks 106 that are oriented to point in the direction of rotation of the first shaft 22.

The second roll assembly 26 is positioned substantially within the interior chamber 54 and parallel to the first shaft 88. The second roll assembly 26 includes a second shaft 108 having a drive end 110 and a support end 114 opposite the drive end 110. The second roll assembly 26 also includes a crushing portion 118 coupled to the second shaft 108. The second shaft 108 defines a second axis 122 between the drive end 110 and the support end 114. The drive end 110 extends through the second support wall 66 and is coupled to the second drive assembly 42 for rotating the second roll assembly 26. The drive end 110 is rotatably supported by a second stationary shaft support 78*b*. The support end 114 extends through the first support wall 66 and is rotatably supported by a first stationary shaft support 78*a*. In one embodiment, the stationary shaft supports 78*a*, 78*b* include a tapered roller bearing for rotatably supporting the second shaft 108. In other embodiments, another type of bearing may be used. The crushing portion 118 is located within the interior chamber 54 and includes multiple picks 126 that are oriented to point in the direction of rotation of the second shaft 26.

The first roll assembly 22 and the second roll assembly 26 are counter-rotating, such that the first roll assembly 22 and the second roll assembly 26 rotate in opposite directions when viewed from a common side. Stated differently, the roll assemblies 22, 26 rotate in opposite directions so that the picks 126 rotate over the top of each roll assembly 22, 26. In the embodiment illustrated in FIG. 3, as viewed along each axis 102, 122 from the first support wall 62, the first roll assembly 22 rotates in a counter-clockwise direction and the second roll assembly 26 rotates in a clockwise direction. As the first roll assembly 22 and the second roll assembly 26 rotate, the picks 106 of the first roll assembly 22 pass between the picks 126 of the second roll assembly 26 without contacting one another. In other embodiments, the roll assemblies 22, 26 may be configured to rotate in another manner.

As shown in FIGS. 2 and 5, the first carriage 30 is positioned proximate the first support wall 62 and supports the first drive assembly 38. The first carriage 30 includes a torque arm track 134 (FIG. 5). The first drive assembly 38 includes a first motor 138, a first gear drive 140, and a first torque limiter 142. The first gear drive 140 receives the drive end 90 of the first shaft 88. The first torque limiter 142 (FIG. 2) removably couples the first motor 138 to the first gear drive 140, maintaining a mechanical connection to transmit power from the first motor 138 to the first shaft 88. If a maximum allowable torque is reached, the torque limiter 142 uncouples the first motor 138 and the first gear drive 130 and permits the first motor 138 to rotate freely. As used herein with respect to a torque limiter, the term "uncouple" and variants thereof generally refer to disconnecting a motor and a gear drive to interrupt the transmission of power from the motor to the gear drive. This includes the slipping of friction discs in a torque limiter.

Figure 5:
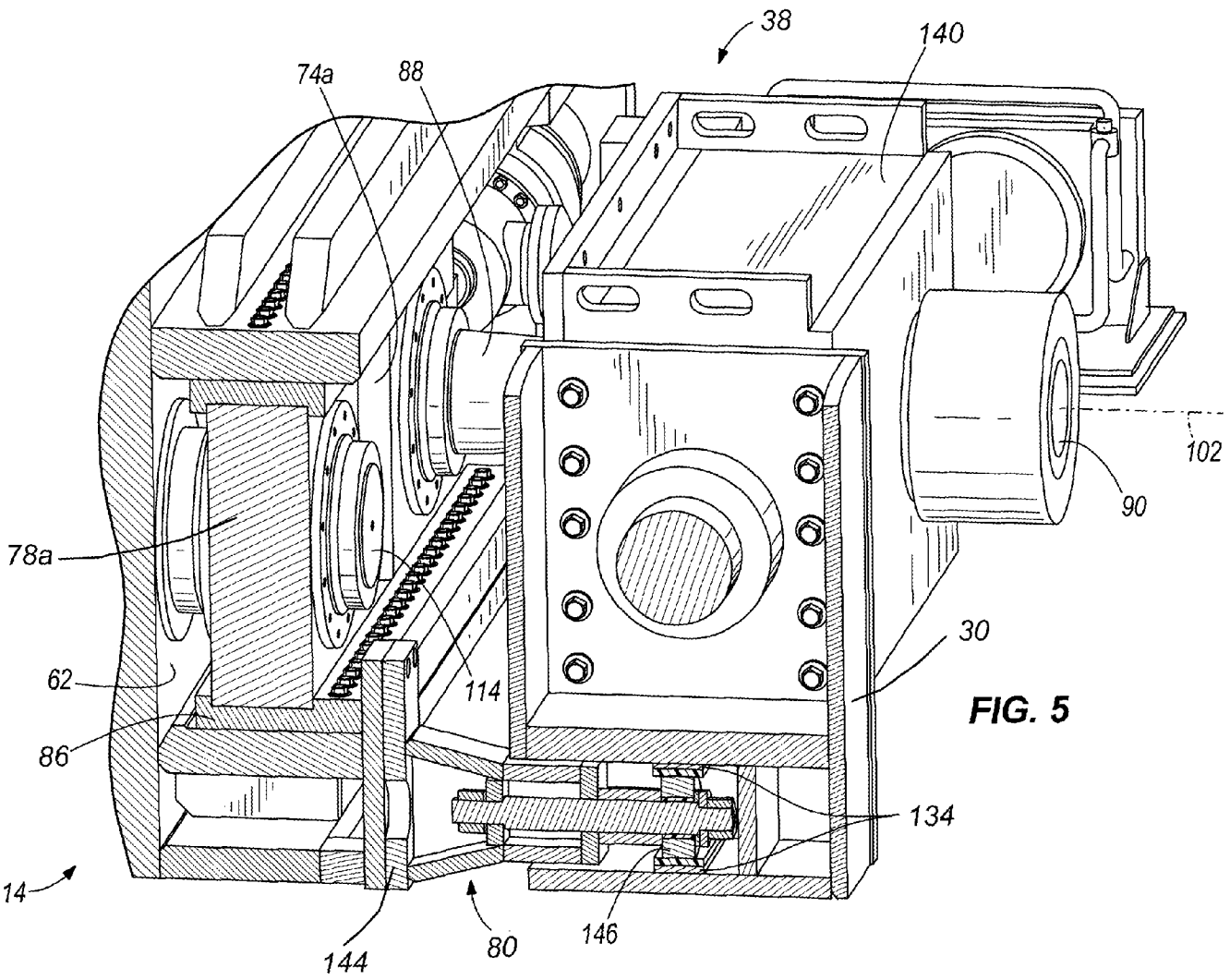
FIG. 5 is a section view of a portion of the roll sizer of FIG. 1 taken along line 5-5.
Figure 6:
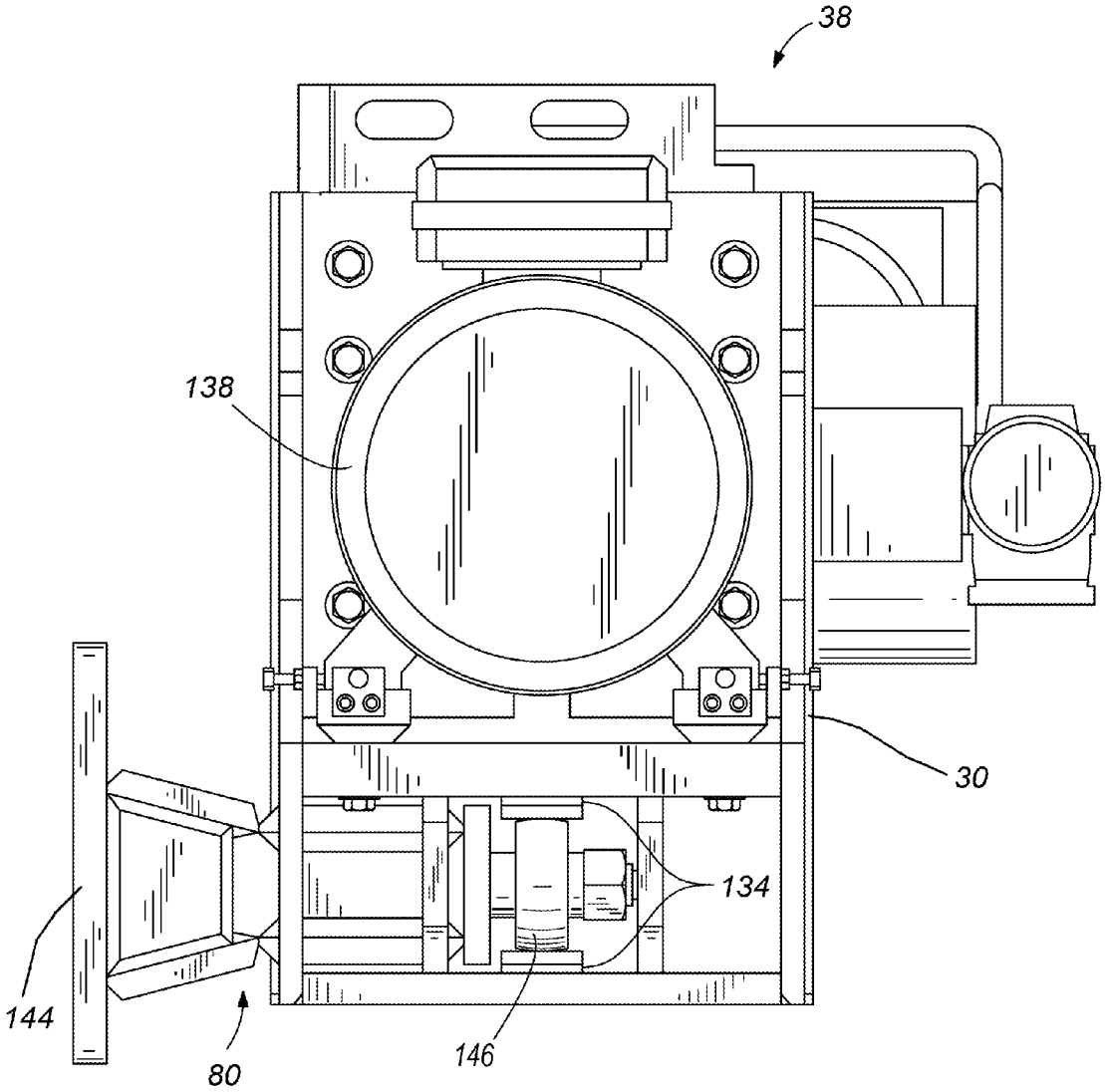
FIG. 6 is a side view of a first carriage, a first drive assembly, and a torque arm.

As illustrated in FIGS. 5 and 6, the torque arm 80 includes a first end 144 coupled to the frame 14 and a second end 146 that moveably engages the torque arm track 134. The torque arm 80 supports the first carriage 30 for movement with respect to the support wall 66 and secures the first carriage 30 against rotation about the first shaft 88. In the illustrated embodiment, the second end 146 rolls with respect to the torque arm track 134. In other embodiments, the second end 146 may move in another manner, such as sliding with respect to the torque arm track 134. In other embodiments, the torque arm track 134 may be coupled to the frame 14 and the torque arm 80 may be coupled to the first carriage 30.

Referring to FIG. 2, the second carriage 34 is positioned proximate the second support wall 66 and supports the second drive assembly 42. In the illustrated embodiment, the second carriage 34 is coupled to the frame 14. The second drive assembly 42 includes a second motor 150, a second gear drive 152, and a second torque limiter 154. The second gear drive 152 receives the drive end 110 of the second shaft 108. The second torque limiter 154 removably couples the second motor 150 to the second gear drive 152, maintaining a mechanical coupling to transmit power from the second motor 150 to the second shaft 108. If a maximum allowable torque is reached, the torque limiter 154 uncouples the second motor 150 and the second gear drive 152 and permits the second motor 150 to rotate freely.

Figure 4:
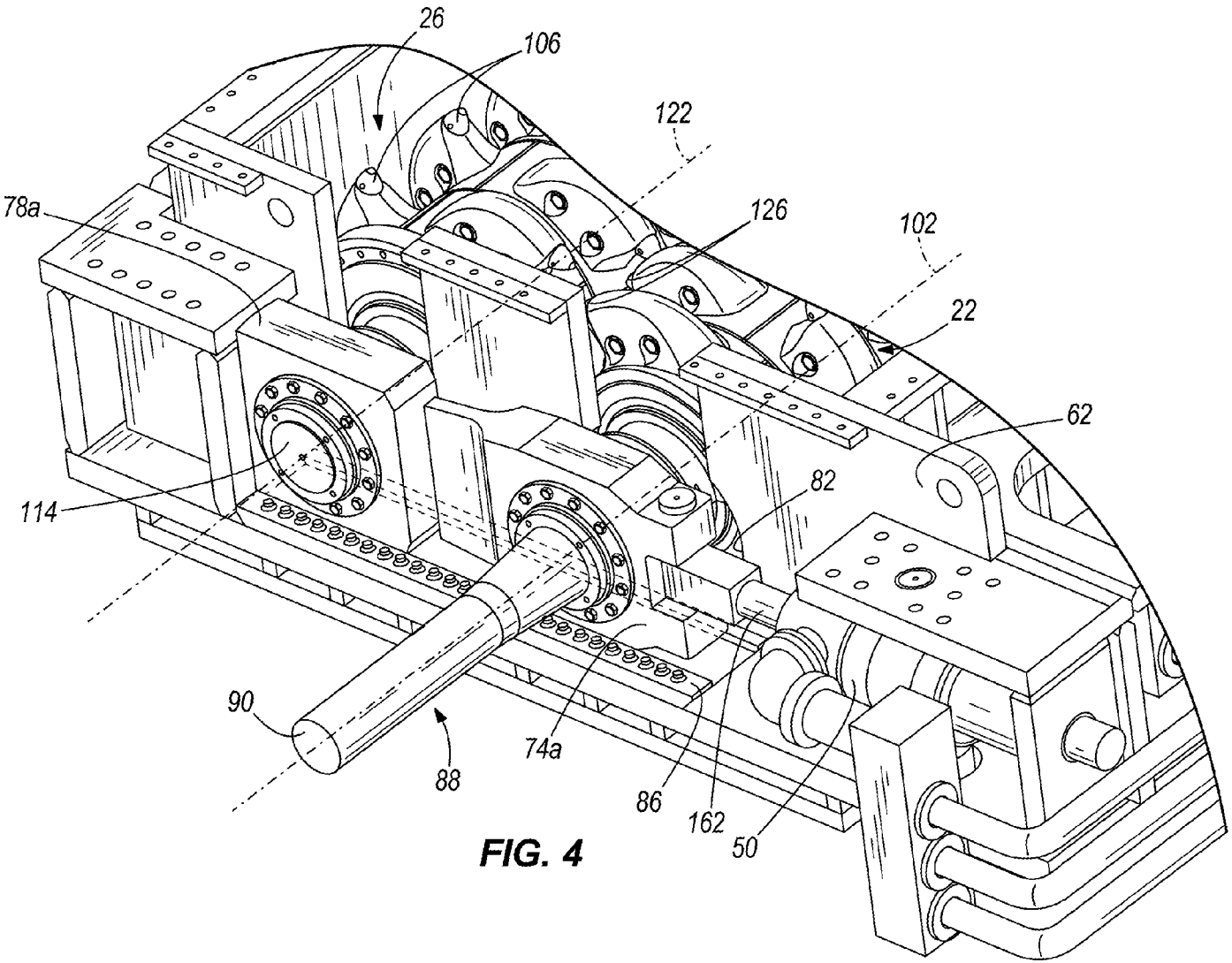
FIG. 4 is an enlarged perspective view of the roll sizer of FIG. 1 with the first drive assembly removed.

As shown in FIGS. 1 and 4, the actuator 50 includes a pair of extendible hydraulic rams 162 positioned adjacent the mobile shaft supports 74*a*, 74*b* in a direction parallel to the track 86 (only the ram 162 adjacent the first mobile shaft support 74*a* is shown in FIGS. 1 and 4; a similar ram is positioned adjacent the second mobile shaft support 74*b*). Pressure in the ram 162 is maintained by a valve (not shown) and is monitored with a pressure sensor (not shown). When the pressure applied on the ram 162 from the contact with the mobile shaft support 74*a* exceeds a given value, the valve is opened and hydraulic fluid is forced out of the ram 162, causing the ram 162 to retract. The rams 162 are coupled to the mobile shaft supports 74*a* such that operation of the rams 162 applies a force to the mobile shaft support 74*a* and moves the mobile shaft support 74*a* along the track 86. The actuator 50 may be configured to either push or pull the shaft support 74*a*.

In other embodiments, when the rams 162 are extended, the rams 162 contact the mobile shaft supports 74*a*, 74*b* to prevent the mobile shaft supports 74*a*, 74*b* from moving along the track 86. When the pressure applied on each ram 162 from the contact with the mobile shaft supports 74*a*, 74*b* exceeds a given value, the valve is opened and the pressure on the ram 162 is decreased, causing the ram 162 to retract and allowing the mobile shaft supports 74*a*, 74*b* to move along the track 86.

During operation of the roll sizer 10, the interior chamber 54 receives material from, for example, a conveyor (not shown). Pieces of the material are urged toward a position between the rotating roll assemblies 22 and 26 where the force of the picks 106, 126 converge, breaking apart the pieces to a desirable size. When a hard material, or tramp, is introduced into the interior chamber 54, the tramp material resists the breaking force of the picks 106, 124. This creates reaction forces on each roll assembly 22, 26, acting in a direction that is either oblique or transverse to each axis 102, 122. As used herein, the term "oblique" refers to a direction that is neither parallel nor perpendicular to either axis 102, 122. As used herein, the term "transverse" refers to a direction that is perpendicular to either axis 102, 122. The reaction forces press the mobile shaft supports 74*a*, 74*b* against the hydraulic rams 162, increasing the hydraulic pressure acting against the ram 162. The pressure sensor detects the pressure increase, and sends an electrical signal to a controller to open the valve and reduce pressure on the ram 162. This allows the rams 162 to retract, allowing the tramp material to pass through the roll assemblies 22, 26. In an alternative embodiment (not shown), the valve may open only by influence of the hydraulic pressure, without the use of an electric sensor.

As shown in FIG. 4, the retraction of the rams 162 permits the mobile shaft supports 74*a*, 74*b* (and therefore the first roll assembly 22) to move along the track 86 in a direction perpendicular to the first axis 102. The first roll assembly 22 moves from a position spaced apart from the second roll assembly 26 by a first distance 170 (FIG. 2) to a position that is spaced apart from the second roll assembly 26 by a second distance 174 that is greater than the first distance 170. The first shaft 88 moves within the slot 82 (FIG. 3) in the first support wall 62, causing the first carriage 30 to move with respect to the frame 14 in a direction parallel to the track 86. The first carriage 30 is supported throughout this motion by the second end 146 of the torque arm 80 (FIGS. 5 and 6), which moves along the torque arm track 134 (FIGS. 5 and 6).

In this manner, the first roll assembly 22 moves away from the second roll assembly 26 in a direction parallel to the track 86, increasing the space between the first roll assembly 22 and the second roll assembly 26. This allows the tramp material to pass through the interior chamber 54 without damaging the roll assemblies 22, 26. In one embodiment, the first shaft 88 travels in a first direction parallel to the track 86 through a distance of approximately 12 inches, and travels in a second direction opposite the first direction through a distance of approximately 4 inches. In one embodiment, the first distance 170 is approximately 62 inches, with alternative shaft supports that allow the operator to configure the first distance 170 to be approximately 64 inches, 66 inches, or 68 inches.

Thus, the invention provides, among other things, a moveable shaft assembly for a roll sizer. Various features and advantages of the invention are set forth in the following claims.

What is claimed is:

1. A roll sizer for a mining crusher, the roll sizer comprising:

a frame including a first support wall and a second support wall, the first support wall including a first shaft track, the second support wall including a second shaft track parallel to the first shaft track;

a first mobile shaft support moveably engaging the first shaft track;

a second mobile shaft support moveably engaging the second shaft track;

a first shaft including a drive end and a support end and defining a first axis therebetween, the drive end being driven by a first motor for rotating the first shaft about the first axis, the first shaft extending from the first support wall to the second support wall, the first shaft being rotatably supported by the first mobile shaft support and the second mobile shaft support; and at least one actuator for applying a force to move the first and second mobile shaft supports along the first and second shaft support tracks, respectively, wherein the first motor moves with the mobile shaft supports while coupled to the first shaft.

2. The roll sizer of claim 1, further comprising a second shaft defining a second axis parallel to the first axis, the second shaft being driven by a second motor for rotating the second shaft.

3. The roll sizer of claim 2, the first shaft further including at least one pick located between the first support wall and the second support wall, the second shaft further including at least one pick located between the first support wall and the second support wall.

4. The roll sizer of claim 2, the first shaft and the second shaft being arranged in a counter-rotating manner.

5. The roll sizer of claim 1, further comprising a carriage supporting the motor, the carriage further supporting a gear drive coupled to the drive end of the first shaft and a first torque limiter for removably coupling the first motor and the gear drive such that, when a torque on the first shaft exceeds a predetermined level, the first torque limiter uncouples the gear drive from the first motor so that the first motor rotates freely.

6. The roll sizer of claim 5, further comprising a torque arm track coupled to one of the frame and the carriage, and a torque arm including a first end and a second end, the first end being coupled to the other of the frame and the carriage, the second end moveably engaging the torque arm track to resist rotation of the carriage about the first shaft.

7. A roll sizer comprising:

a frame including a first wall and a second wall and at least partially defining a sizer chamber;

a carriage supporting a first motor;

a first shaft including a drive end and a support end and defining a first axis therebetween, the drive end coupled to the first motor for rotating the first shaft about the first axis, the first shaft extending between the first wall and the second wall and being movable relative to the first wall and the second wall;

a track coupled to one of the frame and the carriage; and a torque arm extending from the other of the frame and the carriage, the torque arm including an end moveably engaging the track to resist rotation of the carriage about the first shaft.

8. The roll sizer of claim 7, further comprising a second motor and a second shaft defining a second axis parallel to the first axis, the second shaft coupled to the second motor for rotating the second shaft about the second axis.

9. The roll sizer of claim 8, wherein the first shaft includes at least one pick located between the first wall and the second wall, the second shaft further including at least one pick located between the first wall and the second wall.

10. The roll sizer of claim 8, wherein the first shaft and the second shaft are counter-rotating.

11. The roll sizer of claim 7, wherein the carriage also supports a gear drive and a torque limiter, the gear drive being coupled to the drive end of the first shaft and receiving power from the first motor, the first torque limiter removably coupling the motor and the gear drive such that, when a torque on the first shaft exceeds a predetermined level, the torque limiter uncouples the gear drive from the motor so that the motor rotates freely.

12. The roll sizer of claim 7, wherein the torque arm includes a roller rotatably coupled to the end of the torque arm, the roller rollingly engaging the track.

13. The roll sizer of claim 7, further comprising a first block supporting the first shaft proximate the drive end, a second block supporting the first shaft proximate the support end, and an actuator for applying a force to move the first and second blocks relative to the frame, wherein the carriage moves with the first and second blocks while coupled to the first shaft.

14. The roll sizer of claim 13, wherein the actuator moves the first block and the second block when a reaction force exerted on the first shaft exceeds a predetermined level.

15. The roll sizer of claim 7, wherein the first shaft is movable in a direction transverse to the first axis.

16. A roll sizer comprising:

a frame including a first wall and a second wall and at least partially defining a sizer chamber;

a first motor;

a first roller including a drive end and a support end and defining a first axis therebetween, the drive end coupled to the first motor for rotating the first roller about the first axis in a first direction, the first roller extending between the first wall and the second wall and being movable relative to the first wall and the second wall;

a second motor; and a second roller including a drive end and a support end and defining a second axis therebetween, the drive end coupled to the second motor for rotating the second roller about the second axis in a second direction opposite the first direction, the second roller extending between the first wall and the second wall, wherein the first motor is movable with the first roller relative to the first wall and the second wall, the first motor and first roller moving in a direction transverse to the first axis.

17. The roll sizer of claim 16, further comprising a gear drive coupled to the drive end of the first roller and receiving power from the first motor, and a torque limiter removably coupling the first motor and the gear drive such that, when a torque on the first roller exceeds a predetermined level, the torque limiter uncouples the gear drive from the motor so that the motor rotates freely.

18. The roll sizer of claim 17, further comprising a carriage supporting the first motor, the gear drive, and the torque limiter, the carriage being movable relative to the frame, and a torque arm extending from the carriage and including an end moveably engaging a portion of the frame to resist rotation of the carriage about the first axis.

19. The roll sizer of claim 16, wherein the first axis and the second axis are parallel and define a plane, the first roller and the motor being movable in a direction parallel to the plane.

20. The roll sizer of claim 19, further comprising a carriage supporting the first motor and movable relative to the frame;

a track connected to one of the frame and the carriage; and a torque arm extending from the other of the frame and the carriage, the torque arm including an end moveably engaging the track to resist rotation of the carriage about the first shaft.

21. The roll sizer of claim 20, wherein the torque arm moves along the track in a direction parallel to the plane.

22. The roll sizer of claim 15, wherein the torque arm moves along the track in the same direction as the direction of movement of the first shaft.

* * * * *